US009247345B2

(12) United States Patent
Hogan et al.

(10) Patent No.: US 9,247,345 B2
(45) Date of Patent: Jan. 26, 2016

(54) MULTI-CHANNEL AUDIO SYSTEM HAVING A SHARED CURRENT SENSE ELEMENT FOR ESTIMATING INDIVIDUAL SPEAKER IMPEDANCES

(71) Applicant: Apple Inc., Cupertino, CA (US)

(72) Inventors: Roderick B. Hogan, San Francisco, CA (US); Nathan A. Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 98 days.

(21) Appl. No.: 14/252,461

(22) Filed: Apr. 14, 2014

(65) Prior Publication Data

US 2015/0296292 A1 Oct. 15, 2015

(51) Int. Cl.
*H04R 29/00* (2006.01)
*H04R 3/00* (2006.01)

(52) U.S. Cl.
CPC ..... *H04R 3/00* (2013.01)

(58) Field of Classification Search
CPC .... H04R 29/001; H04R 29/002; H04R 29/00; H04R 3/12
See application file for complete search history.

(56) References Cited

U.S. PATENT DOCUMENTS 4,953,218 A * 8/1990 Hughes, Jr. ..... H04R 27/00 381/55
5,625,698 A * 4/1997 Barbetta ..... H04R 3/002 381/59
7,792,310 B2 * 9/2010 Lee ..... H04S 7/308 381/59
8,422,692 B1 4/2013 Dygert et al.
2005/0175195 A1 * 8/2005 Cheney, Jr. ..... G01R 31/041 381/120
2011/0116643 A1 * 5/2011 Tiscareno ..... H04R 1/1016 381/58
2012/0154037 A1 6/2012 Pfaffinger et al.
2013/0044888 A1 * 2/2013 Nystrom ..... H04R 29/001 381/59
2013/0251165 A1 * 9/2013 Jorgensen ..... H04R 29/001 381/59
2014/0348336 A1 * 11/2014 Tong ..... H04R 29/001 381/59

FOREIGN PATENT DOCUMENTS

EP 2229006 B1 11/2013

* cited by examiner

*Primary Examiner* — Simon Sing
(74) *Attorney, Agent, or Firm* — Blakely, Sokoloff, Taylor & Zafman LLP

(57) ABSTRACT

A programmed data processor receives input voltage measurements for a number of speaker drivers, wherein each of the voltage measurements may be a sensed or estimated sequence of time-domain samples of a respective speaker driver input voltage that is over a different time frame. The processor obtains a sensed shared current, being a measure of current in a single power supply rail that is feeding power to each of a number of audio amplifiers, while the audio amplifiers are driving the speaker drivers in accordance with a number of audio channel signals, respectively. The processor computes an estimate of electrical input impedance for each of the speaker drivers using the sensed shared current and the input voltage measurements. Other embodiments are also described and claimed.

20 Claims, 8 Drawing Sheets

$$I_{shared}(t_1) = T_1 \frac{V_1(t_1)}{Z_1} + T_2 \frac{V_2(t_1)}{Z_2} + \cdots T_N \frac{V_N(t_1)}{Z_N}$$

$$I_{shared}(t_2) = T_1 \frac{V_1(t_2)}{Z_1} + T_2 \frac{V_2(t_2)}{Z_2} + \cdots T_N \frac{V_N(t_2)}{Z_N}$$

$$\vdots$$

$$I_{shared}(t_N) = T_1 \frac{V_1(t_N)}{Z_1} + T_2 \frac{V_2(t_N)}{Z_2} + \cdots T_N \frac{V_N(t_N)}{Z_N}$$

$$T_1 = \frac{I_{1,supp}}{I_1}$$

$$T_2 = \frac{I_{2,supp}}{I_2}$$

$$\vdots$$

$$T_N = \frac{I_{N,supp}}{I_N}$$

$$I_{shared}(t_1) = T_1 \frac{V_1(t_1)}{Z_1} + T_2 \frac{V_2(t_1)}{Z_2} + \cdots T_N \frac{V_N(t_1)}{Z_N}$$

$$I_{shared}(t_2) = T_1 \frac{V_1(t_2)}{Z_1} + T_2 \frac{V_2(t_2)}{Z_2} + \cdots T_N \frac{V_N(t_2)}{Z_N}$$

$$\vdots$$

$$I_{shared}(t_N) = T_1 \frac{V_1(t_N)}{Z_1} + T_2 \frac{V_2(t_N)}{Z_2} + \cdots T_N \frac{V_N(t_N)}{Z_N}$$

$$T_1 = \frac{I_{1,\,supp}}{I_1}$$

$$T_2 = \frac{I_{2,\,supp}}{I_2}$$

$$\vdots$$

$$T_N = \frac{I_{N,\,supp}}{I_N}$$

$$I_{shared} = T_A\left(\frac{V_1}{Z_1} + \frac{V_2}{Z_2}\right) + T_B\left(\frac{V_3}{Z_3} + \frac{V_4}{Z_4}\right)$$

$$\begin{cases} I_{shared_lowband}(t_1) = T_A\dfrac{V_1(t_1)}{Z_1} + T_B\dfrac{V_3(t_1)}{Z_3} \\ I_{shared_lowband}(t_2) = T_A\dfrac{V_1(t_2)}{Z_1} + T_B\dfrac{V_3(t_2)}{Z_3} \end{cases}$$

$$\begin{cases} I_{shared_highband}(t_1) = T_A\dfrac{V_2(t_1)}{Z_2} + T_B\dfrac{V_4(t_1)}{Z_4} \\ I_{shared_highband}(t_2) = T_A\dfrac{V_2(t_2)}{Z_2} + T_B\dfrac{V_4(t_2)}{Z_4} \end{cases}$$

MULTI-CHANNEL AUDIO SYSTEM HAVING A SHARED CURRENT SENSE ELEMENT FOR ESTIMATING INDIVIDUAL SPEAKER IMPEDANCES

An embodiment of the invention is related to speaker impedance estimation techniques. Other embodiments are also described.

BACKGROUND

Knowledge of the electrical input impedance of an individual speaker driver can be used to for example predict the operating temperature of the speaker so as to better manage long term reliability of an audio system of which the speaker is an important part. A typical technique for computing speaker driver input impedance senses the input voltage and senses the input current (using a current sense resistor), and then computes their ratio to obtain the impedance.

SUMMARY

In portable electronic audio systems that have multiple speakers and multiple amplifiers, referred to here as multi-channel audio systems, protecting the battery from temporary but excessive current demands, and meeting a finite power budget in view of the battery's limitations, generally requires controlling the total current that is drawn by the audio subsystem. As a result, there is often a need for a current sense element that can sense the shared or total current used by the audio subsystem.

In accordance with an embodiment of the invention, a shared current sensing element in an audio subsystem is used to estimate (compute using digital signal processing techniques) the electrical input impedance of each speaker, without having to sense the individual speaker current or amplifier output current. This approach may help save significant manufacturing costs, as well as printed circuit board area and power consumption, by essentially removing the individual speaker driver current sensing infrastructure (from each audio channel). By eliminating the individual current sensing requirement (where the amplifier output current or the speaker driver input current would have been sensed), a wider range of audio amplifiers may be considered for the audio subsystem design.

In one embodiment of the invention, the speaker driver input voltage is a known variable, either via direct sensing of the amplifier output node or the speaker driver input node voltage, or by estimating the amplifier output voltage in view of the source audio channel signal and an amplifier input-output model (assuming linearity and the absence of amplifier clipping events). The shared current sense element gives an estimate of the total power supply current that feeds two or more amplifiers that are sharing the same power supply rail. These voltages and currents will vary as the audio signal content varies, and a reliable assumption can be made here that there is sufficient channel-to-channel variation (despite the audio channels being part of the same music or movie program or telephone call signal). This variation allows a set of simultaneous equations to be written, e.g. two or more unknowns and two or more equations with such unknowns, which will then allow the individual speaker impedances $Z_1$, $Z_2$, . . . $Z_N$ (and then optionally the speaker driver currents) to be calculated.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness, a given figure may be used to illustrate the features of more than one embodiment of the invention, or more than one species of the invention, and not all elements in the figure may be required for a given embodiment or species.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
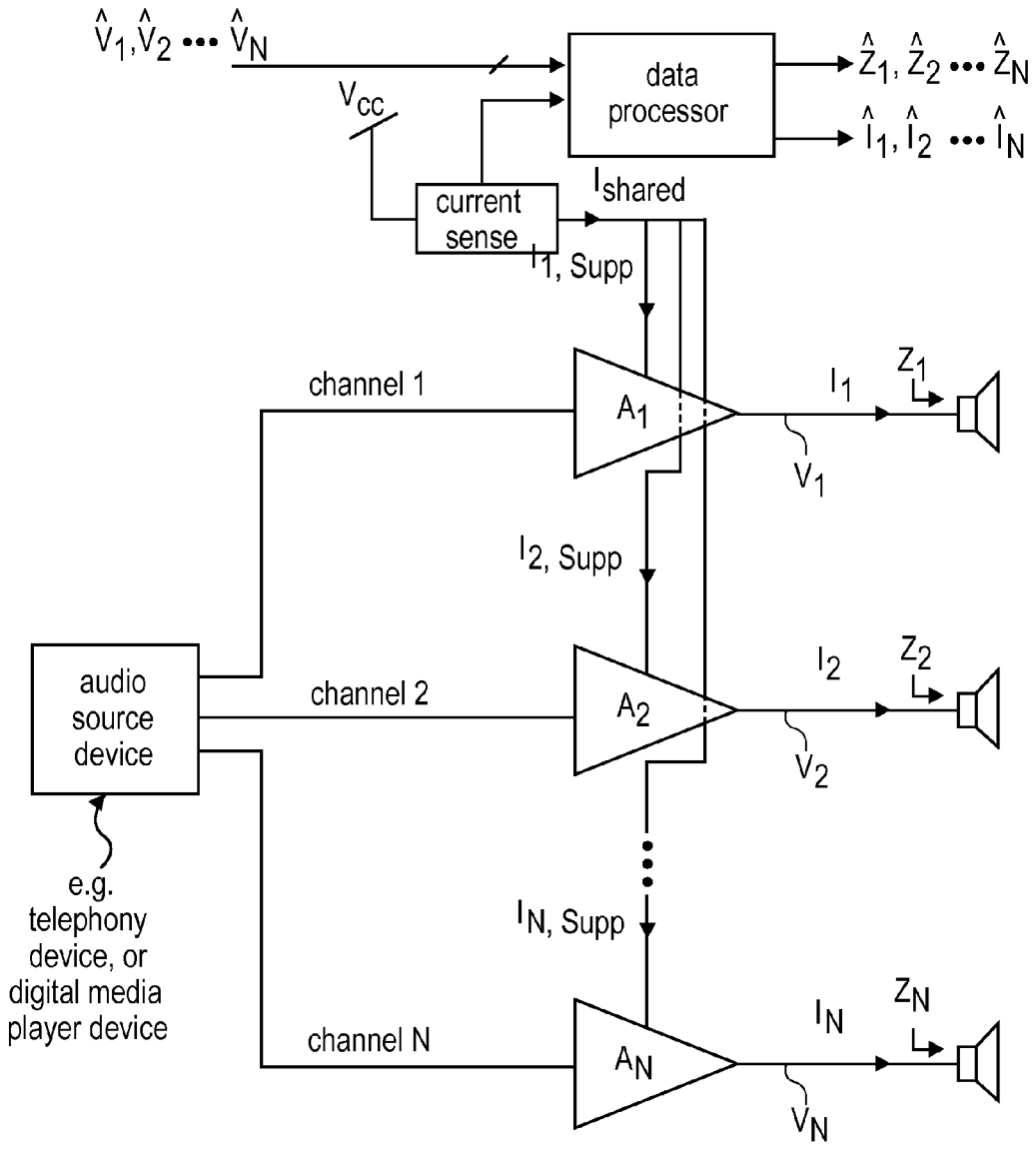
FIG. 1A is a combined block diagram and circuit schematic of a multichannel audio system.

FIG. 1A is a combined block diagram and circuit schematic of a multichannel audio system. This figure will be used to illustrate an audio signal processing system as described further below, as well as a method for operating an audio system having multiple speaker drivers. The system has a number of speaker drivers where each is illustrated as having an electrical input impedance $Z_1$, $Z_2$, . . . $Z_N$, where N is equal to or greater than 2. As an example, the speakers may be conventional electro dynamic speakers or other types of speakers that are suitable for use in consumer electronic devices such as desktop computers, laptop computers, tablet computers, and smartphones, for example. Each speaker driver is coupled to a respective one of several audio amplifiers $A_1, A_2, \ldots A_N$. The output stage of each amplifier may be single ended or it may be differential. The amplifiers may be of various types including linear amplifiers or Class D amplifiers (as explained below for one embodiment). Other suitable amplifier topologies for amplifying an audio signal and driving a speaker driver are possible.

Each of the audio amplifiers is powered from a power supply rail $V_{cc}$. A shared current $I_{shared}$ appears in the power supply rail that may be viewed as a sum of all power supply currents drawn by the amplifiers. Each of the amplifiers may be viewed as drawing its separate supply current $I_{1,\ supp}$, $I_{2,\ supp}, \ldots I_{N,\ supp}$. A current sense element is shown as being coupled to the power supply rail that produces a sensed shared current which is a measure of $I_{shared}$ in the power supply rail. For improved accuracy, the current sense element should use a current sense resistor, and have suitable voltage sensing and conditioning circuitry in addition to an analog-to-digital converter (not shown) so as to produce the sensed shared current in the form of a discrete time sequence being, for example, a sampled version of $I_{shared}$. However, other techniques for sensing the shared current are possible including the use of a current mirror or perhaps a Hall Effect sensor. It should also be noted that while FIG. 1A depicts the current sense element being positioned on the high side of the power supply arrangement, that is between $V_{cc}$ and the high side power supply input of each amplifier, an alternative may be to position the current sense element on the low side, that is between a power supply return or ground connection of each amplifier (not shown) and a circuit ground.

Each of the audio amplifiers is coupled to receive a respective audio channel signal. These may be from an audio source device such as a telephony device or a digital media player device. The N audio channel signals may have been up-mixed from a fewer number of original channels, or they may be a down mix of a greater number of original channels. The audio source device that produces the N audio channel signals may be integrated with the rest of the audio system depicted in FIG. 1A, for example, as part of a laptop computer. In many instances, the speakers shown in FIG. 1A may be built-in speakers, that is built into the housing of the consumer electronics device, although as an alternative one or more of the speakers may be external or detachable. In yet another embodiment, the audio source device may be in a different housing than the amplifiers and speakers, such that the N audio channel signals are delivered through a wired or wireless audio communication link.

Regardless of the particular implementation, the relevant audio system or audio subsystem may have a data processor (e.g., a programmed microprocessor, digital signal processor or microcontroller) that obtains a measure of input voltage for each of the speaker drivers, $Vhat_1, Vhat_2 \ldots Vhat_N$. The data processor computes an estimate of electrical input impedance of each of the speaker drivers, $Zhat_1, Zhat_2 \ldots Zhat_N$, using the sensed shared current (provided by the current sensed element) and the measures of input voltage $Vhat_1, Vhat_2 \ldots Vhat_N$. As seen in FIG. 1A, the speaker driver input voltages $V_1, V_2 \ldots V_N$ may be sensed while their corresponding amplifiers $A_1, A_2 \ldots A_N$ are driving the speaker drivers in accordance with their source audio channel signals. Note here that the speaker driver input voltage may be deemed equivalent to a measure of the corresponding amplifier output voltage, provided that parasitic impedance of the driver signal path between the amplifier output and the speaker driver input is either negligible or can otherwise be accounted through circuit modeling techniques (performed by the programmed data processor). In other words, any reference here to a speaker driver input voltage is understood to also encompass amplifier output voltage.

Figures 1B, 2:
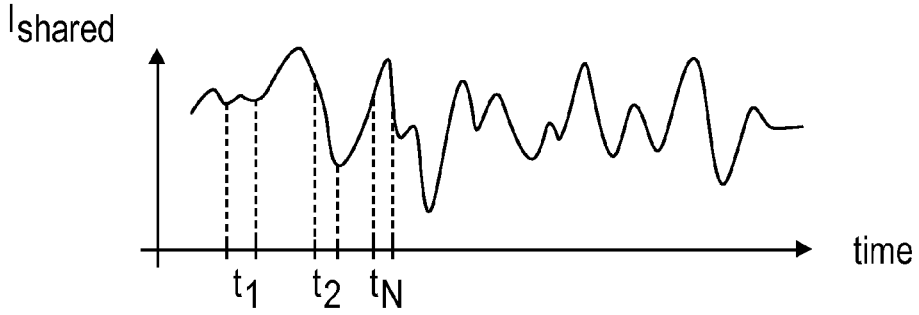
FIG. 1B shows a set of N simultaneous equations for use in estimating individual speaker driver impedance.
FIG. 2 depicts an example waveform for shared current and N time sample intervals.

Turning now to FIG. 1B, this figure depicts a set of two or more (N) simultaneous circuit network equations in which the sensed shared current and the measures of speaker input voltage are the known variables, while the estimates of electrical input impedance are the unknown variables. To solve for N unknown speaker impedance variables, N simultaneous equations are needed. As seen in FIG. 1B, each equation equates the shared current to the sum of the amplifier supply currents, using the terms $T_1, T_2 \ldots T_N$, where $T_i$ is a predetermined mathematical expression that relates the output current of the amplifier $A_i$ to its power supply input current $I_{i,\ supp}$,—see FIG. 1A. In other words, $$T_1 = \frac{I_{1,supp}}{I_1},$$

and so on as given in FIG. 1B. A mathematical expression for $T_i$ can be readily derived using circuit modeling and network analysis techniques that in effect characterize the respective audio amplifier $A_i$, so as to relate the audio amplifier output current (or speaker driver input current that is associated with each amplifier) to the amplifier's input supply current $I_{i,\ supp}$.

Referring to the simultaneous equations in FIG. 1B, the measure of input voltage Vi for each speaker driver may be a measure of instantaneous voltage over a different time interval or time frame, as seen for example in FIG. 2. Here it should be understood that the measures of input voltage for all of the speaker drivers span a time interval over which the electrical input impedances of all of the speaker drivers should remain substantially unchanged, so that the same (unknown) individual speaker impedance is present in every equation. In other words, with the example of FIG. 2, assuming that all samples are taken between $t_1$ and $t_N$, the combined interval spanned by $t_1 \ldots t_N$ is sufficiently short such that the electrical input impedances of all of the drivers remain substantially unchanged during that interval, e.g. remain within 10% of each other. As an example, the combined time interval between $t_1$ and $t_N$ may be less than one-half of a second. Note here, however, that while the intervals $t_1, t_2, \ldots t_N$ are listed in sequence, there is no requirement that the sample intervals be equally-spaced in time, or that the intervals be arranged in a particular order; in other words, the distribution of the selected "sub-intervals" or frames may be random within a given "combined time interval" and there may be some sample overlap between adjacent sub-intervals or frames.

Once the known time-domain values of the variables $I_{shared}$ and $V_i$ have been obtained, the data processor can proceed with computing a frequency domain version, e.g. using a Discrete Fourier Transform (DFT), of the input voltage samples in each sub-interval or frame (per speaker driver). That is because the simultaneous circuit network equations may be solved in the frequency domain, where the known and unknown variables are represented in frequency domain. In other words, the frequency domain versions of the sensed shared current $I_{shared}(t_i)$ and of the input voltage measurements $V_1(t_i), V_2(t_i), \ldots V_N(t_i)$ are the known variables, while the electrical input impedance $Z_1, Z_2, \ldots Z_N$ are unknown variables. Then, having knowledge of $T_i$, the processor can solve the simultaneous sets of equations depicted, to thereby obtain the individual speaker driver input impedances $Z_1$, $Z_2$, . . . $Z_N$.

FIG. 1A, FIG. 1B and FIG. 2 may also be used to illustrate an audio signal processing system in which a programmed data processor (see FIG. 1A) receives a number of input voltage measurements for a number of speaker drivers, where each of the voltage measurements can be sensed time-domain samples (instantaneous voltage) of a respective speaker driver input voltage taken over a different time interval or frame. As suggested above, an analog voltage sensing and A/D conversion infrastructure would be needed in this case to produce a digital or discrete time version of each of the speaker driver input voltages $V_1$, $V_2$ . . . $V_N$. As an alternative, however, the voltage measurements $Vhat_1$, $Vhat_2$ . . . $Vhat_N$ can actually be estimated or computed time-domain samples of a mathematically derived speaker driver input voltage expression, over different time intervals or frames. As another alternative, each of the input voltage measurements can be estimated (computed) directly as a respective spectrum (or the frequency domain content) of its respective time interval or frame. The mathematical relationships that may be derived for the $T_i$ expressions could be used to estimate or predict the output voltage of each audio amplifier, based on the audio channel signal that is input to that amplifier. In such a case, there would be no need for a voltage-sensing infrastructure at the inputs of the speaker drivers.

Once the input voltage measurements $Vhat_1$, $Vhat_2$ . . . $Vhat_N$ have been obtained, together with the sensed shared current, the programmed data processor can compute the estimates of electrical input impedance $Zhat_1$, $Zhat_2$ . . . $Zhat_N$, where these estimates may represent linear time invariant impedance that varies as a function of frequency, while the audio amplifiers are driving their respective speaker drivers in accordance with their respective audio channel input signals. A real-time measure of the individual speaker input impedances can be calculated without requiring a current sense infrastructure at the individual speaker level.

Figure 3B:
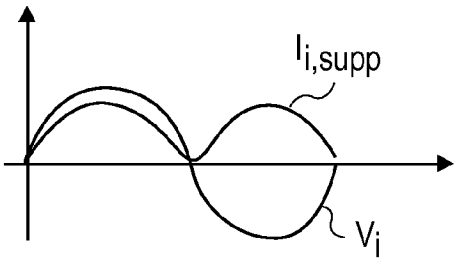
FIG. 3B depicts example waveforms for individual supply current and individual speaker driver input voltage versus time, for an audio system having a Class D amplifier.
Figure 3A:
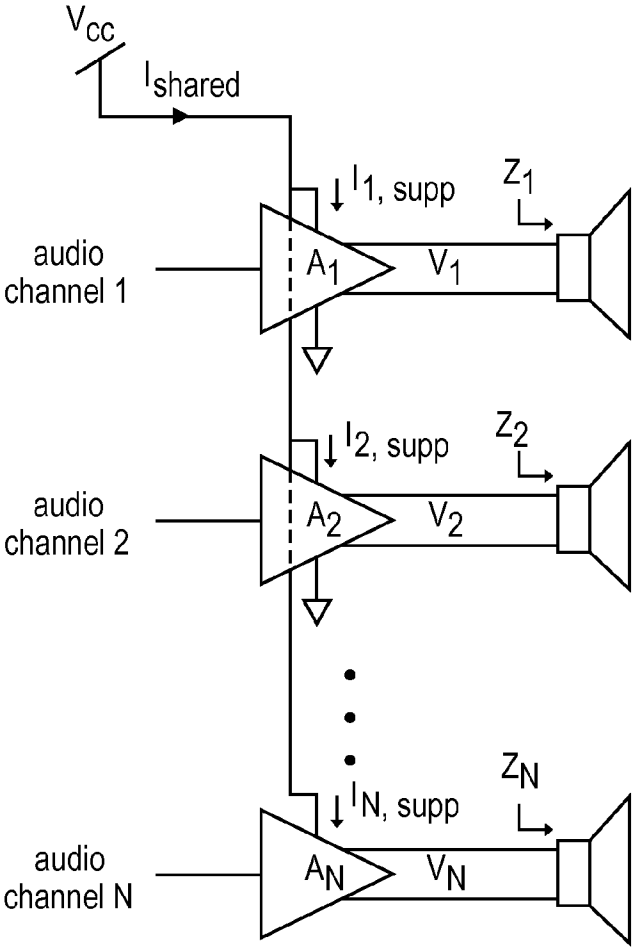
FIG. 3A is a block diagram and circuit schematic of an audio system having Class D amplifiers with differential output.

Turning now to FIG. 3A and FIG. 3B, these figures illustrate an embodiment of the audio system in which the audio amplifiers may be differential output Class D amplifiers. While FIG. 3A does not show the data processor, the shared current sense element, and optional speaker driver input voltage sensing as described above in connection with FIG. 1A, these are understood to be present in a similar manner so as to be able to compute the impedance estimates (also using the simultaneous equations of FIG. 1B). FIG. 3B shows how the amplifier supply current $I_{i,\ supp}$ varies versus time and is, in this case, a somewhat rectified version of the output voltage (or speaker driver input voltage). A half-bridge version of such an amplifier exhibits a squaring effect such that the supply current $I_{i,\ supp}$ becomes roughly proportional to the square of the amplifier output voltage $V_i$. A Class D amplifier with a half-bridge arrangement is particularly efficient and therefore suitable for use in battery powered portable electronic devices, although the concepts here are also applicable to other types of audio amplifiers.

Figure 4:
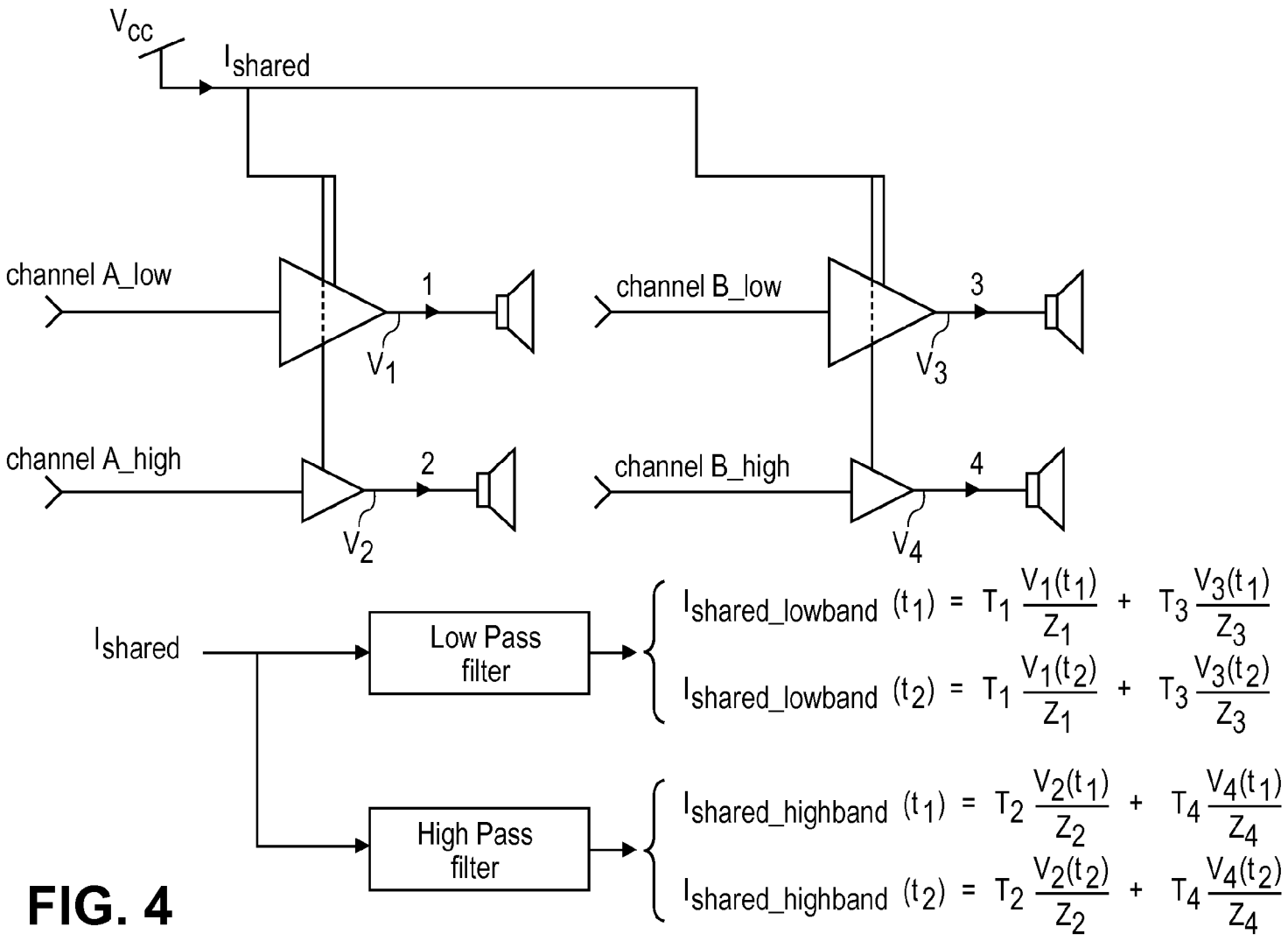
FIG. 4 is a block diagram and circuit schematic of a two-channel audio system having separate low and high frequency speaker drivers, and their associated sets of simultaneous equations.

Turning now to FIG. 4, another embodiment of the invention is shown, as a multi-channel audio system in which there are two channels. The speaker drivers include channel A low frequency (reference number 1), and channel A high frequency (reference number 2), and channel B low frequency (reference number 3), and channel B high frequency (reference number 4). For example, the channel A low frequency drivers 1, 3 may be woofers, while the channel A high frequency drivers 2, 4 may be midranges; in another embodiment, the low frequency drivers 1, 3 may be midranges, while the high frequency drivers are tweeters; other combinations of low and high frequency drivers are possible. A low frequency driver is one that may be designed for more optimal operation in a lower audio frequency band than in a higher audio frequency band; a high frequency driver is the reverse. Each speaker driver may have its associated amplifier, and an associated amplifier and speaker combination may be optimized to operate in the given (low or high) audio frequency band. In accordance with an embodiment of the invention, the following beneficial result may be obtained when computing the estimates of the electrical input and impedance of each of these low and high frequency drivers.

While there are four different speaker drivers shown in the embodiment of FIG. 4, which may initially suggest that a set of four simultaneous equations are needed, to be solved to compute the four variables that require the solution, this task may be considerably simplified by recognizing that the shared current Ishared will have a low band component and a high band component, where these components may be extracted using suitable low pass and high pass filters, respectively. The latter may be digital filters that receive at their inputs the discrete time sequence of Ishared as sensed by the current sense element (see FIG. 1A), while the output of each filter is a filtered discrete time sequence, being a low band portion Ishared_low, or a high band portion, Ishared_high, of the sensed shared current. This assumption holds because the input signals to the amplifiers can be segregated into a channel A low band and a channel A high band, as well as a channel B low band and a channel B high band. Having recognized this, the input impedances Z1 and Z3 (of the low frequency drivers) can be computed using a set of just two simultaneous equations as shown. Similarly, the input impedances Z2, Z4 (of the high frequency drivers) can be computed using just a set of two simultaneous equations as shown. More generally, the data processor computes estimates of a) electrical input impedance of each of the low frequency drivers using the low frequency band portion of the sensed shared current, along with the measures of input voltage of the low frequency drivers, not the high frequency drivers, and b) electrical input impedance of each of high frequency drivers using the high frequency band portion of the sensed shared current, along with the measures of input voltage of the high frequency drivers, not the low frequency drivers. It is expected that solving a set of two simultaneous equations in two unknowns in this manner is a significantly easier computation task than solving a set of four simultaneous equations in four unknowns. The programmed data processor (see FIG. 1A) in this case may be able to process the two sets of simultaneous equations in parallel in order to obtain the speaker driver input impedances in an expeditious manner.

Figure 5:
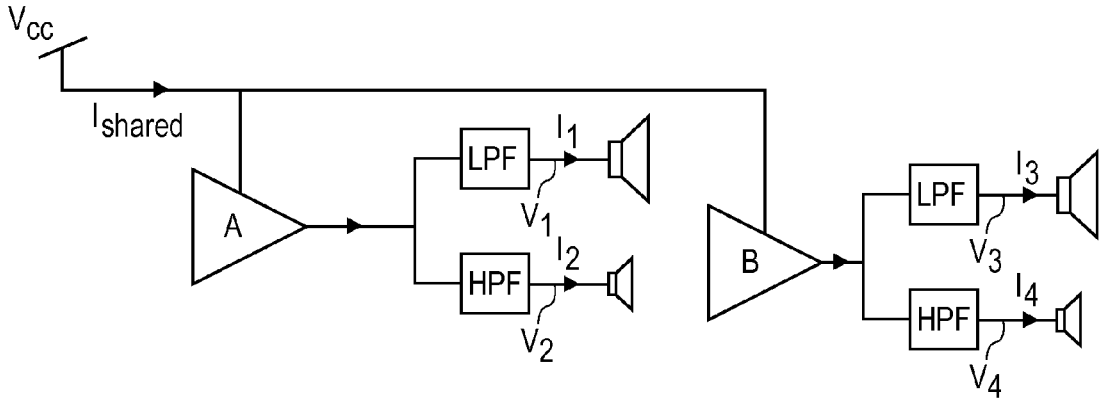
FIG. 5 is another two-channel audio system with separate low and high frequency drivers and analog crossover networks.

Turning now to FIG. 5, this diagram illustrates another embodiment of a two-channel, four speaker driver audio system, this time using analog cross over networks which are a low pass filter (LPF) and a high pass filter (HPF). This is in contrast to the embodiment of FIG. 4 in which each of the audio source channel A and B signals was separated into low and high band portions in the digital or discrete-time domain. The simultaneous equations shown for the analog cross over approach in FIG. 5 are expected be similar in form to those of the digital approach in FIG. 4 but may have more complicated expressions for $T_A$ and $T_B$ (relating amplifier output current to its input supply current) due to additional consideration that needs to be give to the cross over networks that are located between the amplifier outputs and the speaker drivers.

Figure 6:
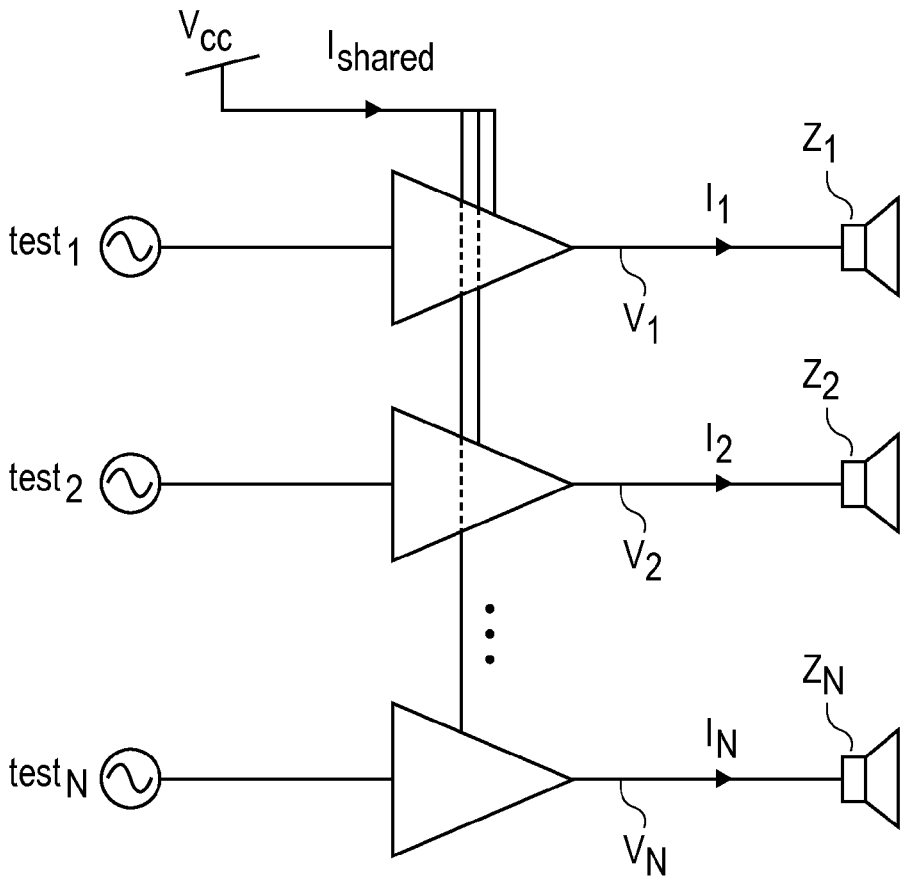
FIG. 6 is a circuit schematic of a multi-channel audio system having a shared current sensing infrastructure that uses test signals to estimate the individual speaker impedances.

Referring now to FIG. 6, a combined block diagram and circuit schematic of a multi-channel audio system is shown that is using N test signals test1, test2, . . . testN (one for each channel), for estimating the individual speaker driver input impedances Z1, Z2, . . . ZN. Each of the test signals may be produced by the data processor (see FIG. 1A) and is applied to the input of its respective amplifier, which in turn is driving the respective speaker driver. While FIG. 6 does not show the data processor, the shared current sense element, and optional speaker driver input voltage sensing as described above in connection with FIG. 1A, these are understood to be present in a similar manner so as to be able to compute the impedance estimates using the sensed shared current and the obtained measures of input voltage of the speaker drivers (using the simultaneous equations of FIG. 1B).

Figure 7:
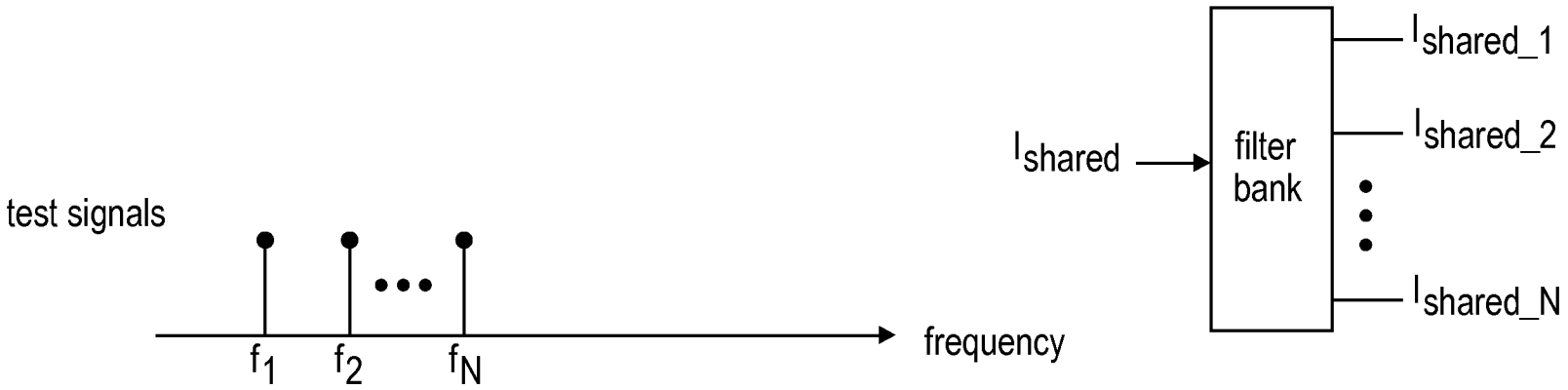
FIG. 7 shows one embodiment of the test signals and the shared current sense infrastructure.

In one embodiment, each of the audio channel test signals is a test tone that is centered at a different frequency. If desired to be inaudible, the frequency (spectral) content of each test signal may be designed to be below the human audible range. The resulting sensed shared current will contain a number of peaks each of which roughly aligns (in frequency) with a respective one of the test tones, due to the power supply current draw of the respective amplifier. This embodiment is illustrated in FIG. 7, which shows a spectral diagram of N test tones centered at frequencies f1, f2, . . . fN, respectively. Each test tone may be a non-overlapping, narrow-band or band-limited signal that is centered at a different frequency, e.g. a single-frequency component having a known or fixed magnitude at a known center frequency. The test signals may be generated by the programmed data processor. Note that the test tones need not be spaced equally as shown and instead could even be positioned randomly. A filter bank (or other suitable band pass-type filter mechanism) filters the sensed shared current (while the test tones were being applied to their respective amplifiers A1, A2, . . . $A_N$), to extract the distinct peaks as N output signals where each is a measure of the contribution from each amplifier. Each of the output signals may be deemed to be a measure of a peak in Ishared that is aligned with the frequency of a respective tone that is input to a respective amplifier. The data processor (see FIG. 1A) then computes the estimate of the electrical input impedance of each of the speaker drivers using a) the measure of a respective one of the peaks, and b) the measure of input voltage for the associated speaker driver. For example, to compute the estimate of Z1, the following equation (having just one unknown) can be solved for Z1

$$I\text{shared_1 (produced by the filter bank)}=T1*V1/Z1$$

where T1 is an expression that relates the output current of amplifier A1 to its input supply current (as explained earlier). Note that as a result of the effectively "orthogonal" nature of the test signals, each amplifier is fed its own or "unique" test signal and so there is no need to solve any simultaneous equations as in FIG. 1B. Also, in many cases the speaker driver impedance estimate is of interest in just one or perhaps no more than a few adjacent frequency bins. As a result, the math can simplified greatly by using for example the Goertzel algorithm to obtain the frequency domain versions of $I_{shared(ti)}$ and $V_1(t_i)$, $V_2(t_i)$, . . . , rather than a DFT. More generally, the impedance estimation process performed by the programmed data processor here may have the following operations: filtering the sensed shared current to produce a number of filtered output signals each being aligned with a respective one of the different frequencies; and computing the estimate of the electrical input impedance of each of the speaker drivers using one of the filtered output signals and the measure of input voltage of the speaker driver that is associated with said one of the filtered output signals.

Figure 8:
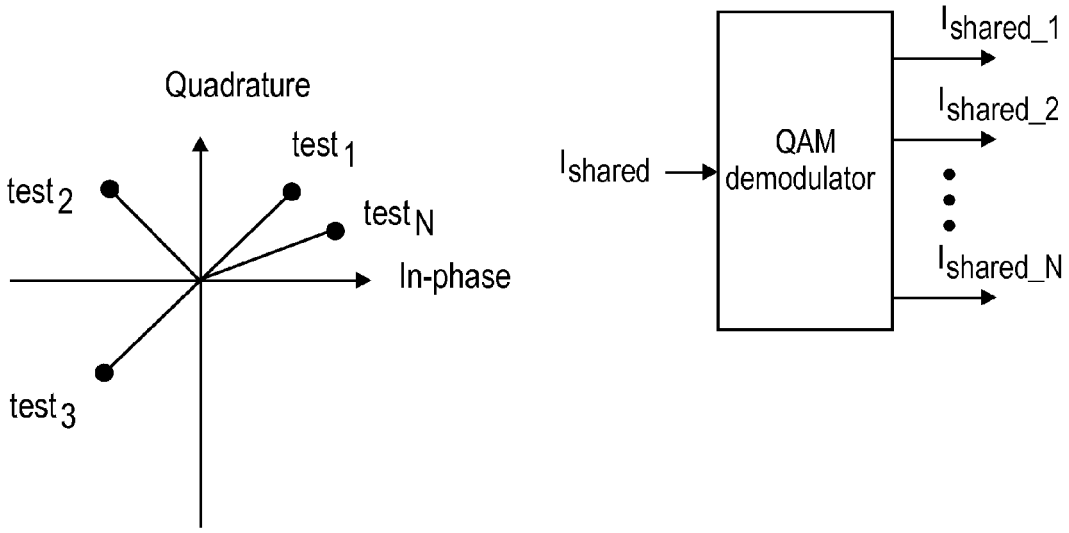
FIG. 8 shows another embodiment of the test signals and shared current sense infrastructure.

In another embodiment, each of the audio channel test signals is a unique phase-modulated or phase-encoded test signal. As a result, the sensed shared current will contain a modulation signature, for each modulated test signal, that is due to the power supply current draw of the respective amplifier. This embodiment is illustrated using the example constellation diagram in FIG. 8, which shows Quadrature Amplitude Modulation (QAM) as an example of phase modulation that may be applied to each test signal. Each test tone may be a non-overlapping phase-modulated signal that has different phase modulation. Note that the test tones need not be spaced equally as shown and instead could even be positioned randomly in the constellation diagram. A QAM demodulator (or other phase demodulator or decoder that is complementary to the modulation used to produce the test signals) processes the sensed shared current (while the test tones were being applied to their respective amplifiers A1, A2, . . . AN), to produce N output signals where each is a measure of the contribution from each amplifier. The data processor (see FIG. 1A) then computes the estimate of the electrical input impedance of each of the speaker drivers using a) the measure of a respective one of the decoded components, and b) the measure of input voltage for the associated speaker driver. For example, to compute the estimate of Z2, the following equation (having just one unknown) can be solved for Z2

$$I\text{shared_2 (produced by the demodulator)}=T2*V2/Z2$$

where T2 is an expression that relates the output current of amplifier A2 to its input supply current (as explained earlier). Note that as a result of the effectively "orthogonal" nature of the test signals, each amplifier is fed its own or "unique" phase-encoded test signal and so there is no need to solve any simultaneous equations as in FIG. 1B. The test signals may be generated by the programmed data processor using any suitable phase modulation technique. More generally, the impedance estimation process performed by the programmed data processor here may have the following operations: where each of the audio channel test signals is a unique phase modulated test signal, the sensed shared current is phase demodulated into a number of demodulated output signals; and the estimate of the impedance of each of the speaker drivers is computed using one of the demodulated output signals and the measure of input voltage of the speaker driver that is associated with said one of the demodulated output signals.

Figure 9:
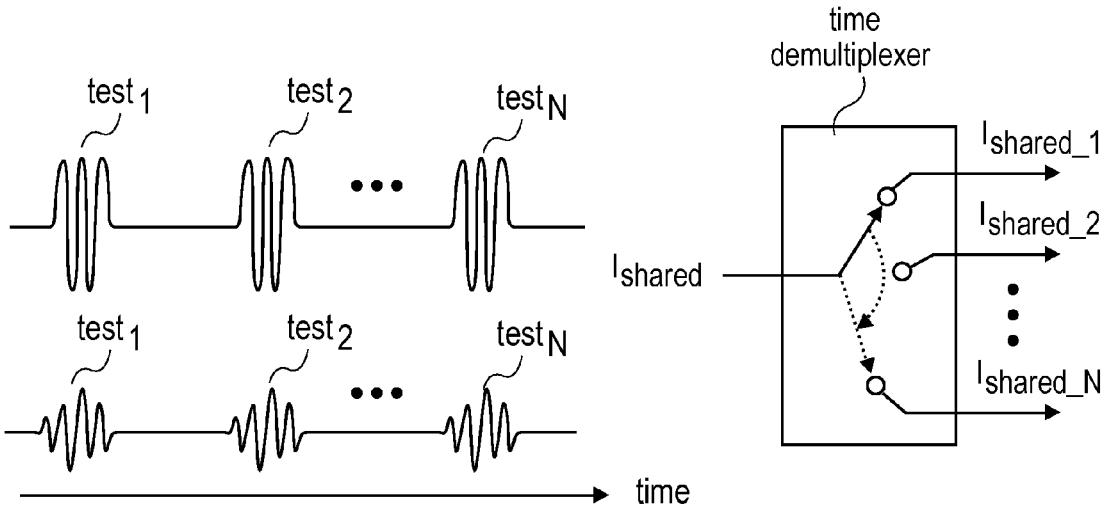
FIG. 9 shows yet another embodiment of the test signals and shared current sense infrastructure.

In yet another embodiment, the N audio channel test signals contain test content that are in effect time division multiplexed. In other words, when the N test signals are supplied to their respective amplifiers, the amplifiers are driven with test content one at a time. For convenience, the test content may be the same in each signal only shifted in time so that none of them overlaps with another—these are depicted by two examples in FIG. 9, including one where the test content consists of several cycles of pure sinusoid or a shaped sinusoid. Other forms of test content are possible. This is contrast to the above-described embodiment of FIG. 7 in which the test content (which may be the same in each signal) is shifted in frequency. Here, the sensed shared current will contain a number of peaks each of which roughly aligns in time with the test content in a respective one of the test signals, due to the power supply current draw of the respective amplifier. Note that the test content across all of the test signals need not be spaced equally as shown, and also need not have the same time interval or burst length, and instead could even be sized and positioned randomly. As shown in FIG. 9, a time demultiplexer extracts each of the respective test content from the sensed shared current (while the test signals were being applied to their respective amplifiers A1, A2, . . . AN), to produce N output signals where each is a measure of the contribution from each amplifier. Each of the output signals may be deemed to be a measure of a portion of Ishared that is aligned in time with a respective test signal that is input to a respective amplifier. The data processor (see FIG. 1A) then computes the estimate of the electrical input impedance of each of the speaker drivers using a) the measure of a respective one of the output signals from the demultiplexer, and b) the measure of input voltage for all of the associated speaker driver. For example, to compute the estimate of Z3, the following equation (having just one unknown) can be solved for Z3

$$I\text{shared_3 (produced by the demultiplexer)}=T3*V_3/Z_3$$

where T3 is an expression that relates the output current of amplifier A3 to its input supply current (as explained earlier), and Ishared_3 and $V_3$ are given by their frequency domain versions. Note that as a result of the effectively "orthogonal" nature of the test signals, each amplifier is fed its own or "unique" test signal and so there is no need to solve any simultaneous equations as in FIG. 1B. The test signals may be generated by the programmed data processor. More generally, the impedance estimation process performed by the programmed data processor here may have the following operations: where each of the audio channel test signals has test content that is shifted in time (or time-multiplexed) so that none of the test content in the test signals overlaps in time with another test content, the sensed shared current is first demultiplexed (in accordance with the known timing with which the test signals were produced) into a number of for example burst-like output signals; the estimate of the impedance of each of the speaker driver is computed using one of the output signals and the measure of input voltage of the speaker driver that is associated with said one of the pulse output signals. It should be noted here that while the time-division multiplexing technique may be used in place of the frequency-shifting and phase-encoding techniques described earlier, an alternative is to combine it with either the frequency-shifting or phase-encoding techniques so that the test content in either of those cases is applied one at a time (sequentially or randomly) to the amplifiers, which may make it easier to extract the test content from the sensed shared current.

As explained above, an embodiment of the invention may be a machine-readable medium (such as microelectronic memory) having stored thereon instructions, which program one or more data processing components (generically referred to here as a "processor") to perform the digital audio processing operations described above including arithmetic operations, filtering, mixing, inversion, comparisons, and decision making. In other embodiments, some of these operations might be performed by specific hardware components that contain hardwired logic (e.g., dedicated digital filter blocks). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the description above refers to techniques for estimating individual speaker impedances, this should be understood as also encompassing the alternative but equivalent mathematical construct of computing individual speaker admittances, where admittance is the inverse of impedance and is typically defined as Y=1/Z. The description is thus to be regarded as illustrative instead of limiting.

What is claimed is:

1. A method for operating an audio system having a plurality of speaker drivers, comprising:

providing a plurality of audio channel signals simultaneously to inputs of a plurality of audio amplifiers, respectively, while each of the audio amplifiers is driving its respective speaker driver;

sensing current of a single power supply rail that is feeding power to each of the plurality of audio amplifiers, while each of the amplifiers is driving its respective speaker driver, to produce a sensed shared current;

obtaining a measure of input voltage of each of the speaker drivers; and computing an estimate of electrical input impedance of each of the speaker drivers using the sensed shared current and the measures of input voltage.

2. The method of claim 1 wherein computing the estimate of electrical input impedance comprises:

solving a set of two or more simultaneous circuit network equations in which the sensed shared current and the measures of input voltage are in known variables, and the estimates of electrical input impedance are in unknown variables.

3. The method of claim 2 wherein for each of the speaker drivers, the measure of input voltage is a measure of instantaneous voltage over a different time interval, but that the measures of input voltage for all of the speaker drivers span a combined time interval over which the electrical input impedances of all of the speaker drivers remain substantially unchanged.

4. The method of claim 1 obtaining a measure of input voltage of each of the speaker drivers comprises:

computing a frequency domain version of the input voltage of each of the speaker drivers over a different time interval, wherein the different time intervals for all of the speaker drivers span a combined time interval over which the electrical input impedances of all of the speaker drivers remain substantially unchanged.

5. The method of claim 1 wherein each of the plurality of audio channel signals is a test signal.

6. The method of claim 1 wherein the plurality of audio channel signals comprise a first audio channel low band signal, a first audio channel high band signal, a second audio channel low band signal, and a second audio channel high band signal, wherein the speaker drivers of the amplifiers that are receiving the first channel and second channel low band signals are low frequency drivers, and the speaker drivers of the amplifiers that are receiving the first channel and second channel high band signals are high frequency drivers.

7. The method of claim 6 further comprising:

filtering the sensed shared current to produce a low frequency band portion of the sensed shared current; and filtering the sensed shared current to produce a high frequency band portion of the sensed shared current, wherein computing an estimate of a) electrical input impedance of each of the low frequency drivers uses the low frequency band portion of the sensed shared current along with the measures of input voltage of the low frequency drivers, not the high frequency drivers, and b) electrical input impedance of each of the high frequency drivers uses the high frequency band portion of the sensed shared current along with the measures of input voltage of the high frequency drivers, not the low frequency drivers.

8. An audio system comprising:

a data processor;

a power supply rail;

a current sense element coupled to the power supply rail to produce a sensed shared current being a measure of current in the power supply rail;

a plurality of audio amplifiers each being coupled to be powered by the power supply rail and to receive a respective audio channel signal; and a plurality of speaker drivers each being coupled to a respective one of the amplifiers;

wherein the data processor obtains a measure of input voltage for each of the speaker drivers, and computes an estimate of electrical input impedance of each of the speaker drivers using the sensed shared current and the measures of input voltage.

9. The system of claim 8 wherein the data processor computes the estimate of electrical input impedance using a set of two or more simultaneous circuit network equations in which the sensed shared current and the measures of input voltage are in known variables, and the estimates of electrical input impedance are in unknown variables.

10. The system of claim 9 wherein the data processor obtains the measure of input voltage for each speaker driver as instantaneous voltage over a different time interval, and the measures of input voltage for all of the speaker drivers span a combined time interval over which the electrical input impedances of all of the speaker drivers remain substantially unchanged.

11. The system of claim 8 wherein the data processor obtains the measure of input voltage for each speaker driver by computing a frequency domain version of a sampled time sequence of the input voltage that is over a respective time frame, and the data processor computes a frequency domain version of the sensed shared current over the respective frame, and wherein all of said respective time frames together span a combined time interval over which the electrical input impedances of all of the respective speaker drivers remain substantially unchanged.

12. The system of claim 8 wherein the plurality of speaker drivers comprise first channel low and high frequency drivers, and second channel low and high frequency drivers.

13. The system of claim 12 further comprising:

a first filter having an input coupled to receive the sensed shared current, the first filter to produce a low frequency band portion of the sensed shared current; and a second filter having an input coupled to receive the sensed shared current, the second filter to produce a high frequency band portion of the sensed shared current, wherein the data processor computes estimates of a) electrical input impedance of each of the low frequency drivers using the low frequency band portion of the sensed shared current along with the measures of input voltage of the low frequency drivers, not the high frequency drivers, and b) electrical input impedance of each of high frequency drivers using the high frequency band portion of the sensed shared current along with the measures of input voltage of the high frequency drivers, not the low frequency drivers.

14. An audio signal processing system comprising:

a programmed data processor that is to receive a plurality of input voltage measurements for a plurality of speaker drivers, wherein each of the voltage measurements is a sensed or estimated sequence of time-domain samples of a respective speaker driver input voltage that is over a different time frame, the programmed data processor to obtain a sensed shared current being a measure of current in a single power supply rail that is feeding power to each of a plurality of audio amplifiers, while the audio amplifiers are driving the speaker drivers in accordance with a plurality of audio channel signals, respectively, and the programmed data processor to compute an estimate of electrical input impedance of each of the speaker drivers using the sensed shared current and the input voltage measurements.

15. The system of claim 14 wherein the data processor computes the estimates of electrical input impedance of the speaker drivers using a set of simultaneous circuit network equations in which frequency domain versions of the sensed shared current and the input voltage measurements are in known variables, and the estimates of electrical input impedance are unknown variables.

16. The system of claim 15 wherein the plurality of input voltage measurements in their entirety span a combined time interval over which the electrical input impedances of all of the speaker drivers remain substantially unchanged.

17. The system of claim 15 wherein the processor is to compute a frequency domain version of each of the input voltage measurements, and a frequency domain version of the sensed shared current, and the plurality of input voltage measurements as a whole span a combined time interval over which the electrical input impedances of all of the speaker drivers remain substantially unchanged.

18. The system of claim 14 wherein the input voltage measurements are those of a first channel low frequency driver, a first channel high frequency driver, a second channel low frequency driver, and a second channel high frequency driver.

19. The system of claim 18 wherein the programmed data processor is to filter the sensed shared current to produce a low frequency band portion of the sensed shared current, and to filter the sensed shared current to produce a high frequency band portion of the sensed shared current, and wherein the data processor computes estimates of a) electrical input impedance of each of the low frequency speaker drivers using the low frequency band portion of the sensed shared current along with the input voltage measurements of the low frequency drivers and not the high frequency drivers, and b) electrical input impedance of each of the high frequency drivers using the high frequency band portion of the sensed shared current along with the input voltage measurements of the high frequency drivers and not the low frequency drivers.

20. The system of claim 14 wherein the programmed data processor produces each of the plurality of audio channel signals as a respective test signal.

* * * * *